US007439838B2

(12) United States Patent
Chen et al.

(10) Patent No.: US 7,439,838 B2
(45) Date of Patent: Oct. 21, 2008

(54) TRANSFORMERS AND WINDING UNITS THEREOF

(75) Inventors: Yu-Chan Chen, Taoyuan Hsien (TW); Kai-Yuan Cheng, Taoyuan Hsien (TW); I-Chi Cheng, Taoyuan Hsien (TW); Hsin-Wei Tsai, Taoyuan Hsien (TW); Wen-Pin Feng, Taoyuan Hsien (TW); Heng-Cheng Chou, Taoyuan Hsien (TW); Kao-Tsai Liao, Taoyuan Hsien (TW); Yi-Fan Wu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/508,270

(22) Filed: Aug. 23, 2006

(65) Prior Publication Data

US 2007/0057757 A1 Mar. 15, 2007

(30) Foreign Application Priority Data

Sep. 9, 2005 (TW) ..... 94130971 A
Jun. 30, 2006 (TW) ..... 95211491 U

(51) Int. Cl.
*H01F 27/30* (2006.01)

(52) U.S. Cl. ..... 336/198

(58) Field of Classification Search ..... 336/65, 336/83, 192, 198, 200, 232
See application file for complete search history.

(56) References Cited

U.S. PATENT DOCUMENTS 5,175,525 A * 12/1992 Smith ..... 336/83
5,534,839 A * 7/1996 Mackin et al. ..... 336/192
5,559,487 A * 9/1996 Butcher et al. ..... 336/178
6,420,953 B1 * 7/2002 Dadafshar ..... 336/200
6,522,233 B1 * 2/2003 Kyoso et al. ..... 336/200

* cited by examiner

*Primary Examiner*—Tuyen T. Nguyen
(74) *Attorney, Agent, or Firm*—Birch, Stewart, Kolasch & Birch, LLP

(57) ABSTRACT

Transformers are provided. A transformer comprises a ferromagnetic core unit; a bobbin coupled with the ferromagnetic core unit; at least a winding unit as a primary winding and at least a plate as a secondary winding. Also, some of the winding units can act as a secondary winding. At least a winding unit and at least a plate are alternatively stacked in a staggered manner. A conductive wire is wound around the winding unit.

25 Claims, 9 Drawing Sheets

100

202

TRANSFORMERS AND WINDING UNITS THEREOF

BACKGROUND OF THE INVENTION

1. Field of the Invention

The invention relates in general to transformers and in particular to transformers having winding units.

2. Description of the Related Art

Transformers are widely applied in electronic devices to transform drive voltage from circuits, such as conventional power transformers to lower voltage or step-up transformers used in monitors to raise an operating voltage from circuits. Conventional transformers can be made to measure for various types, wherein miniaturization is usually a significant requirements.

Generally, a transformer requires at least a primary winding and a secondary winding. The primary winding receives an input voltage, and the secondary winding generates an output voltage by electromagnetic induction from the primary winding. Function of the transformer depends on turn ratio of the primary and secondary windings.

Referring to FIG. 1, a conventional transformer 10 primarily comprises a ferromagnetic core 11 and a bobbin 12. A primary winding 13, an insulating tape 14 and a secondary winding 15 are sequentially wound around the bobbin 12. As shown in FIG. 1, the insulating tape 14 is wound at the exterior of the primary winding 13, adversely increasing dimension of the transformer and complicating assembly. Moreover, when windings are not appropriately arranged, the transformer can fail and influence yield. Further, the insulating tapes may obstruct heat dissipation, shortening life of the transformer and adversely affecting peripheral electronic devices.

In this regard, it is important to provide a transformer having low cost, simple structure, small dimension and high heat dissipation efficiency.

BRIEF SUMMARY OF THE INVENTION

Thus, the invention provides a transformer comprising a ferromagnetic core unit, a bobbin coupled with the ferromagnetic core unit, at least a winding unit and at least a plate. The bobbin comprises at least a recess and at least a pin, wherein the recess has a guiding slope. The winding unit is coupled with the bobbin to act as a primary winding. The plate, such as a printed circuit board, copper or metal sheets, is coupled with the bobbin to act as a secondary winding.

The winding unit has a non-winding portion and a winding portion with a conductive wire wound thereon. The conductive wire, such as a triple-insulated wire or an enamel-insulated wire, is wound substantially on the same plane to reduce dimension of the transformer. Specifically, the winding and the non-winding portions are disposed on different planes to form a space therebetween. The winding portion comprises a first joining portion and at least a rib. When joining the winding unit to the bobbin, the bobbin can be engaged by the first joining portion easily, wherein the rib and the bobbin are press-fitted in order to eliminate excessive strain and to prevent sliding therebetween.

The winding units and the plates are alternately stacked along the bobbin in a staggered manner, wherein a space is defined by the winding portion and the non-winding portion for receiving the plate. The plate comprises a first joining portion and a first hole. The first joining portion is engaged with a second joining portion of the bobbin. The first hole is disposed on an aspect different from the non-winding portion to prevent short-circuit. A bolt is fastened through the first hole and a second hole of the bobbin corresponding to the first hole. In some embodiments, the plate can be a copper sheet or a printed circuit board.

The transformer further comprises an insulating sheet sandwiched in between the ferromagnetic core unit and the plate. The insulating sheet, such as a Mylar sheet, comprises a first joining portion engaged with to the second joining portion of the bobbin.

According to the aspect of the present invention, the transformer comprises a plurality of winding units stacked along the bobbin, wherein some of the winding units are to act as a primary winding, and some of winding units are to act as a secondary winding. The winding portion of the winding unit can be disposed on the bobbin in order to reduce dimension of the transformer.

The winding units of the transformer can be easily mounted on the bobbin, wherein turns of the wire on each winding unit can be appropriately adjusted for various applications. Moreover, each of the bobbin and the winding units comprises a recess and a guiding slope in order to facilitate guidance and protect the wire, so that unintentional damage of the wire during the assembling is prevented, and life of the transformer is potentially increased.

Transformers of the present invention have smaller dimensions than conventional transformers to prevent excess height and to save considerable space for other electronic devices. In some embodiments, each of the winding units comprises a rib press-fitted to the bobbin in order to prevent sliding therebetween and to simplify winding assembly of the transformer. Moreover, each of the bobbins, the plates and the insulating sheets comprises a joining portion corresponding to each other to provide easy assembly and firm connection of the bobbin.

Unlike conventional transformers using tapes, the invention provides a transformer having a sandwiched structure to prevent inductance leakage and to improve heat dissipation efficiency.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE INVENTION

Figure 1:
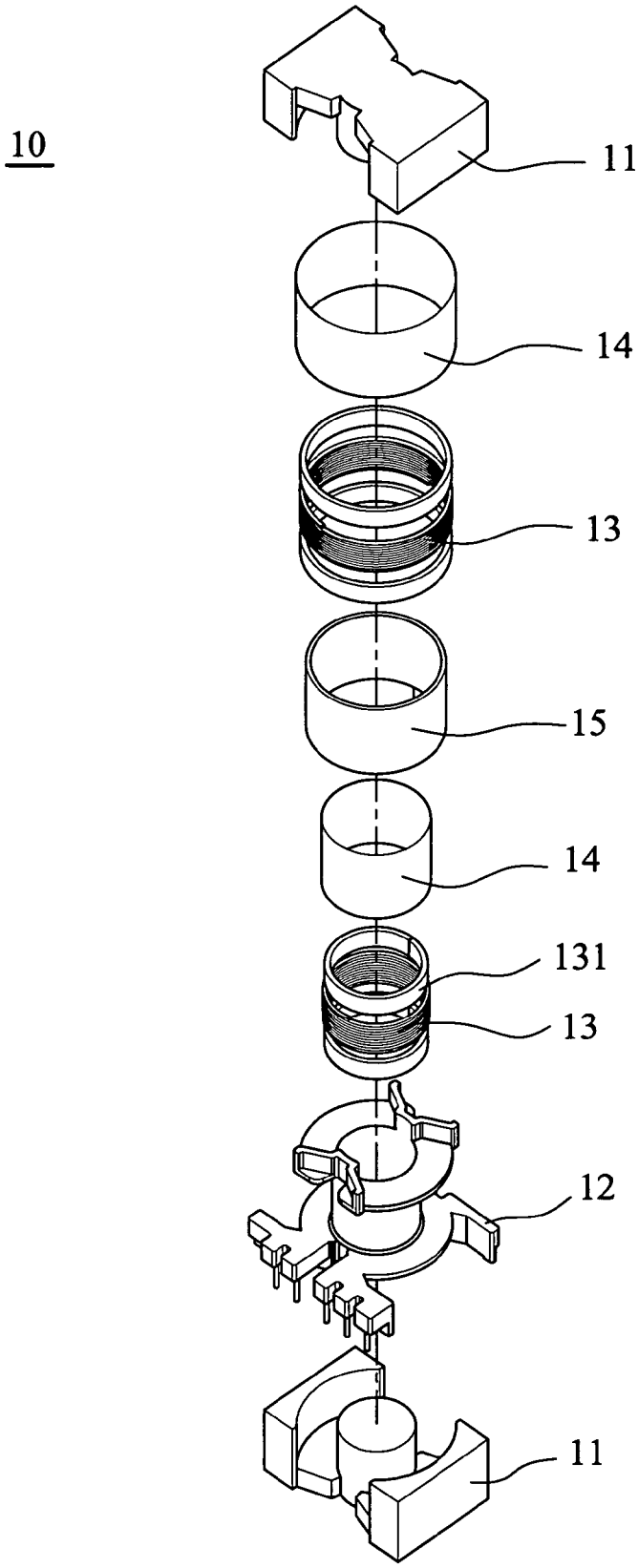
FIG. 1 ( RELATED ART )
FIG. 1 is an exploded diagram of a conventional transformer.
Figure 2:
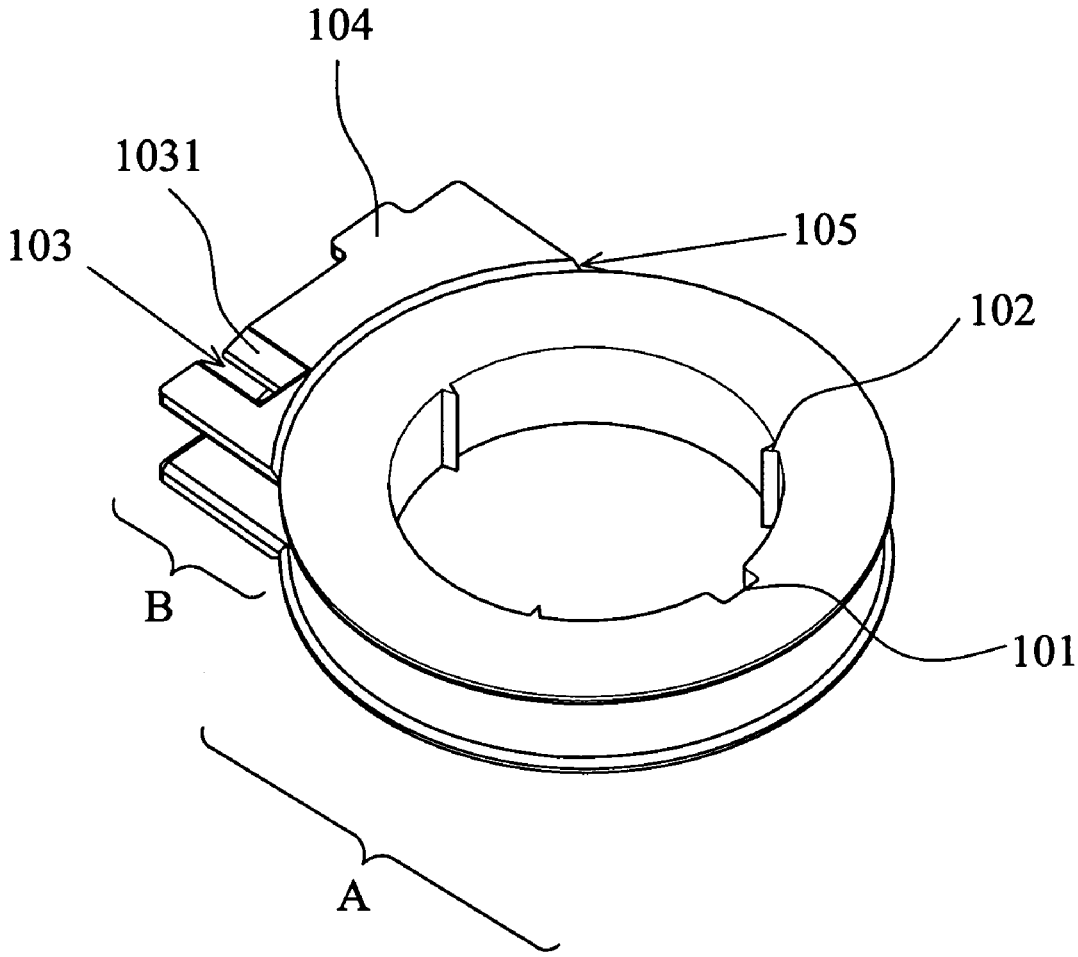
FIG. 2 is a schematic diagram of a first winding unit according to the present invention.

FIG. 2 shows a first embodiment of a first winding unit 100 having a winding portion A and a non-winding portion B. A conductive wire, such as a triple-insulated wire (not shown), is wound around the winding portion A substantially on the same plane in order to facilitate height reduction of transformer 200 shown in FIG. 3A.

In FIG. 2, the winding portion A and the non-winding portion B respectively have end surfaces situated on different horizontal planes. The winding portion A comprises a first joining portion 101 and at least a rib 102. When assembling the first winding unit 100 to a bobbin, such as the bobbin 202 shown in FIG. 3C and will be described thereafter, the bobbin is engaged through the first joining portion 101, wherein the rib 102 and the bobbin are press-fitted to eliminate excessive strain and to prevent sliding therebetween.

The non-winding portion B comprises at least a recess 103 and a protrusion 104. The recess 103 has a slope 1031 to receive the conductive wire. The protrusion 104 guides the wire with the wire crossing therethrough.

Figure 3A:
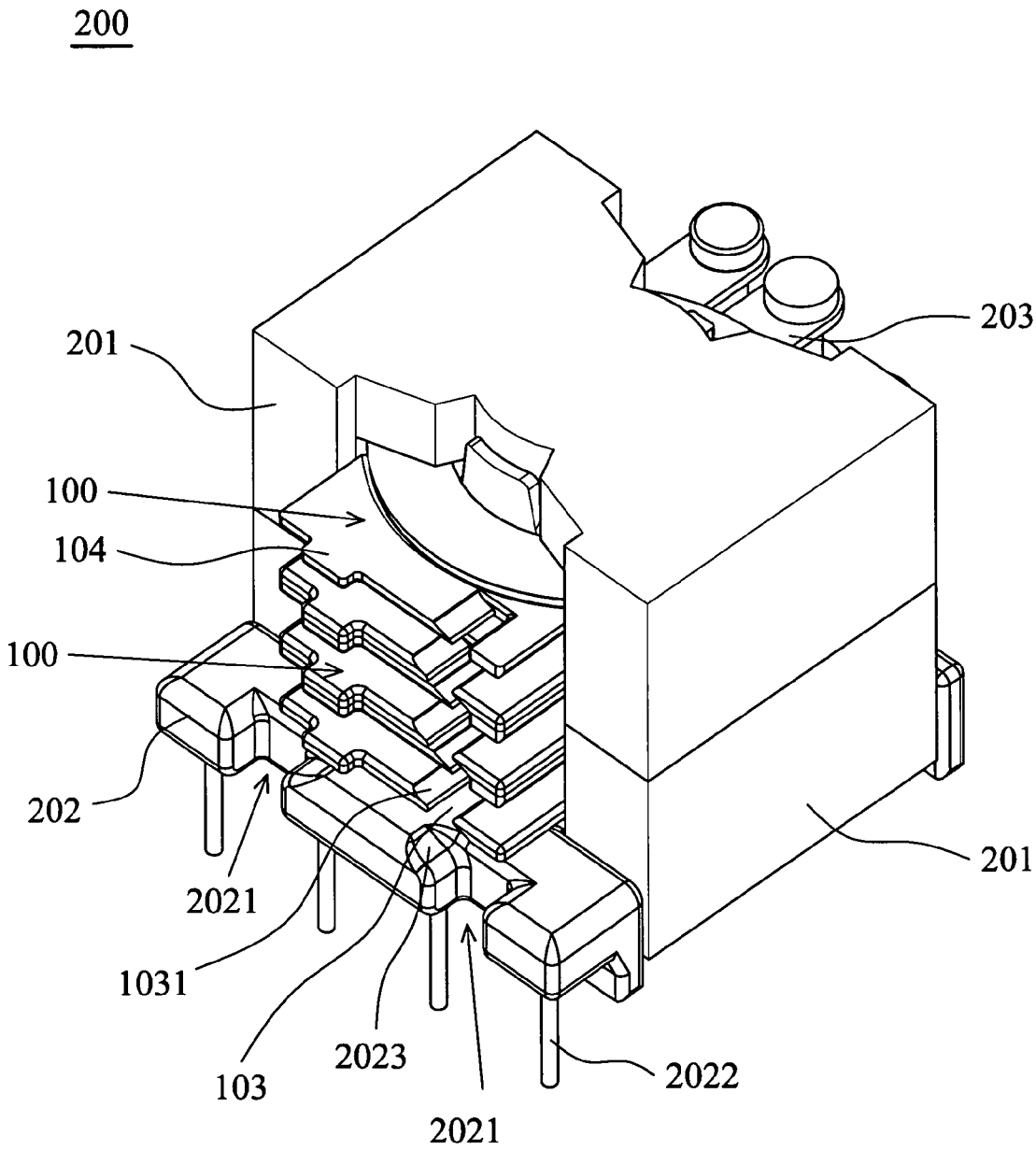
FIG. 3A is a schematic diagram of a first embodiment of a transformer according to the present invention.
Figure 3B:
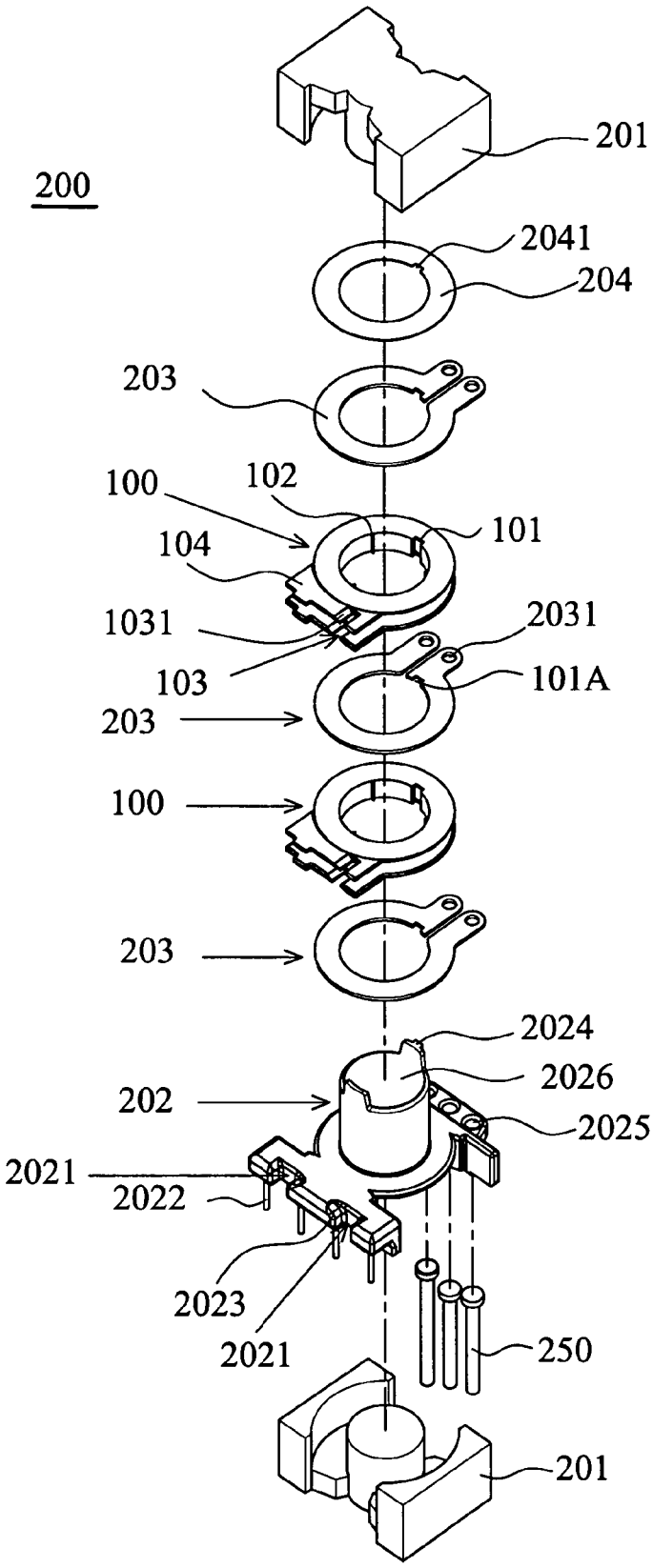
FIG. 3B is an exploded diagram of the transformer shown in FIG. 3A.
Figure 3C:
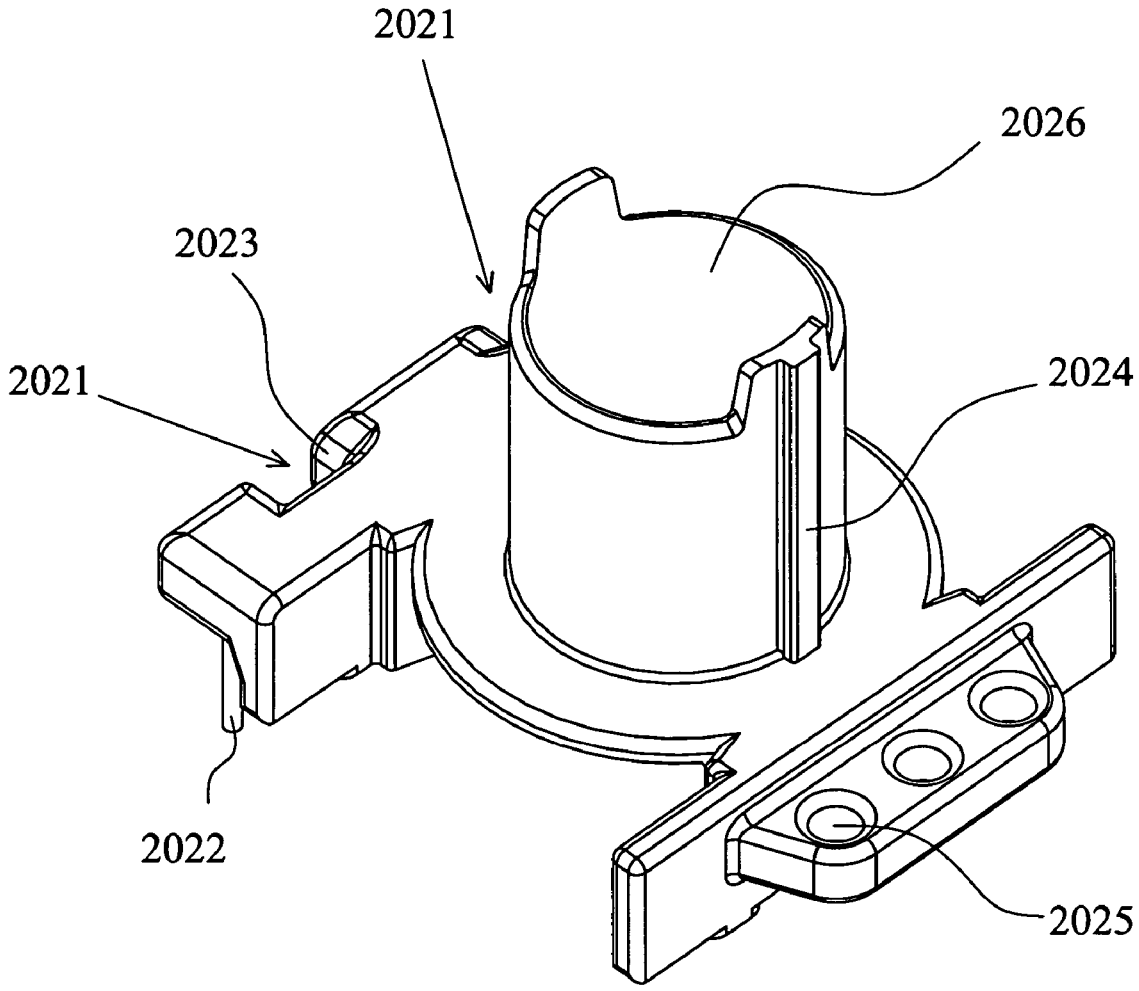
FIG. 3C is a schematic diagram of the first bobbin shown in FIG. 3A.

FIGS. 3A and 3B are schematic and exploded diagrams of a transformer 200 comprising a plurality of winding units 100 shown in FIG. 2. Elements corresponding to those of FIGS. 2, 3A and 3B share the same reference numerals. The transformer 200 comprises a ferromagnetic core unit 201, a first bobbin 202 coupled with the ferromagnetic core unit 201, at least a first winding unit 100 and at least a first plate 203. The first bobbin 202 comprises at least a recess 2021 and at least a pin 2022, wherein the recess 2021 has a slope 2023. As shown in FIGS. 3A and 3B, a plurality of winding units 100 are to act as a primary winding with the first bobbin 202. A plurality of first plate 203, such as printed circuit boards or metal sheets, are to act as a secondary winding coupled with the first bobbin 202. Specifically, the winding units 100 and the first plates 203 are alternately stacked along the first bobbin 202 in a staggered manner, wherein the winding portion A and the non-winding portion B of each first winding unit 100 are situated on different horizontal planes to form a space 105 shown in FIG. 2 for receiving the first plate 203. In this embodiment the space 105 formed between two adjacent first winding units 100 is substantially equal to the size of the first plate 203 after assembling. Referring to FIG. 3B, the first plate 203 comprises a first joining portion 101A and a first hole 2031. The first joining portion 101A is engaged with a second joining portion 2024 of the first bobbin 202, as shown in FIG. 3C. Specifically, the first hole 2031 is situated on an aspect different from the non-winding portion B to prevent short circuit. In this embodiment, a bolt 250 is fastened through the first hole 2031 and a second hole 2025 of the first bobbin 202, correspondingly.

During the assembling of the transformer, one end of a conductive wire (not shown) is mounted on the pin 2022, wherein the wire is led through the recess 103 and across the slope 1031, and then wound on the winding portion A. Subsequently, the wire is led back through the slope 1031 and the recess 103, and the first winding unit 100 is engaged to the first bobbin 202. In this embodiment, the wire can be further wound on other winding units 100 sequentially by repeating assembly steps, wherein the winding units 100 and the first plates 203 are alternately stacked adjacent to each other to form a sandwiched structure. Finally, the wire is led across each protrusion 104 of the winding units 100, and the tail of the wire is mounted on other pin 2022.

As shown in FIG. 3B, the transformer 200 further comprises an insulating sheet 204 sandwiched adjacent to the ferromagnetic core unit 201, the first plate 203 or the first winding unit 100. The insulating sheet 204, such as a Mylar sheet, comprises a joining portion 2041 engaged with the second joining portion 2024 of the first bobbin 202.

During the assembling, the winding units 100 and the first plates 203 are alternately stacked to form a sandwiched structure with the first bobbin 202 in a staggered manner, wherein the insulating sheet 204 is sandwiched by the winding units 100, the first plates 203 or the ferromagnetic core unit 201. Subsequently, two parts of the ferromagnetic core unit 201 are fastened through the first bobbin 202 respectively from both ends of a tabular portion 2026 thereof. As shown in FIG. 3B, the two parts of the ferromagnetic core unit 201 are E-shaped ferromagnetic cores. In this embodiment, the primary and secondary windings are assembled as a horizontal stack type transformer.

Figure 6A:
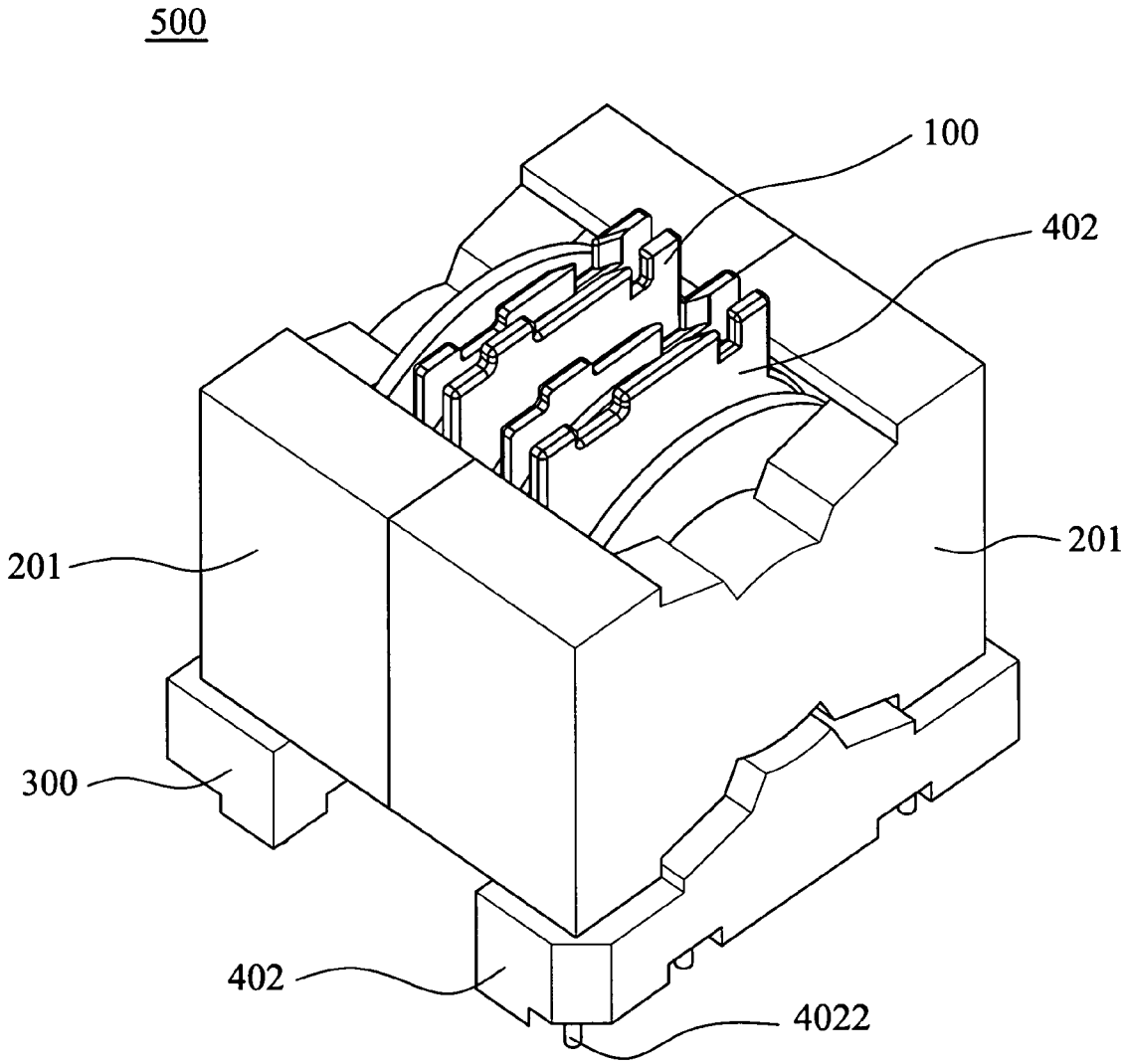
FIG. 6A is a schematic diagram of a second embodiment of a transformer according to the present invention.
Figure 6B:
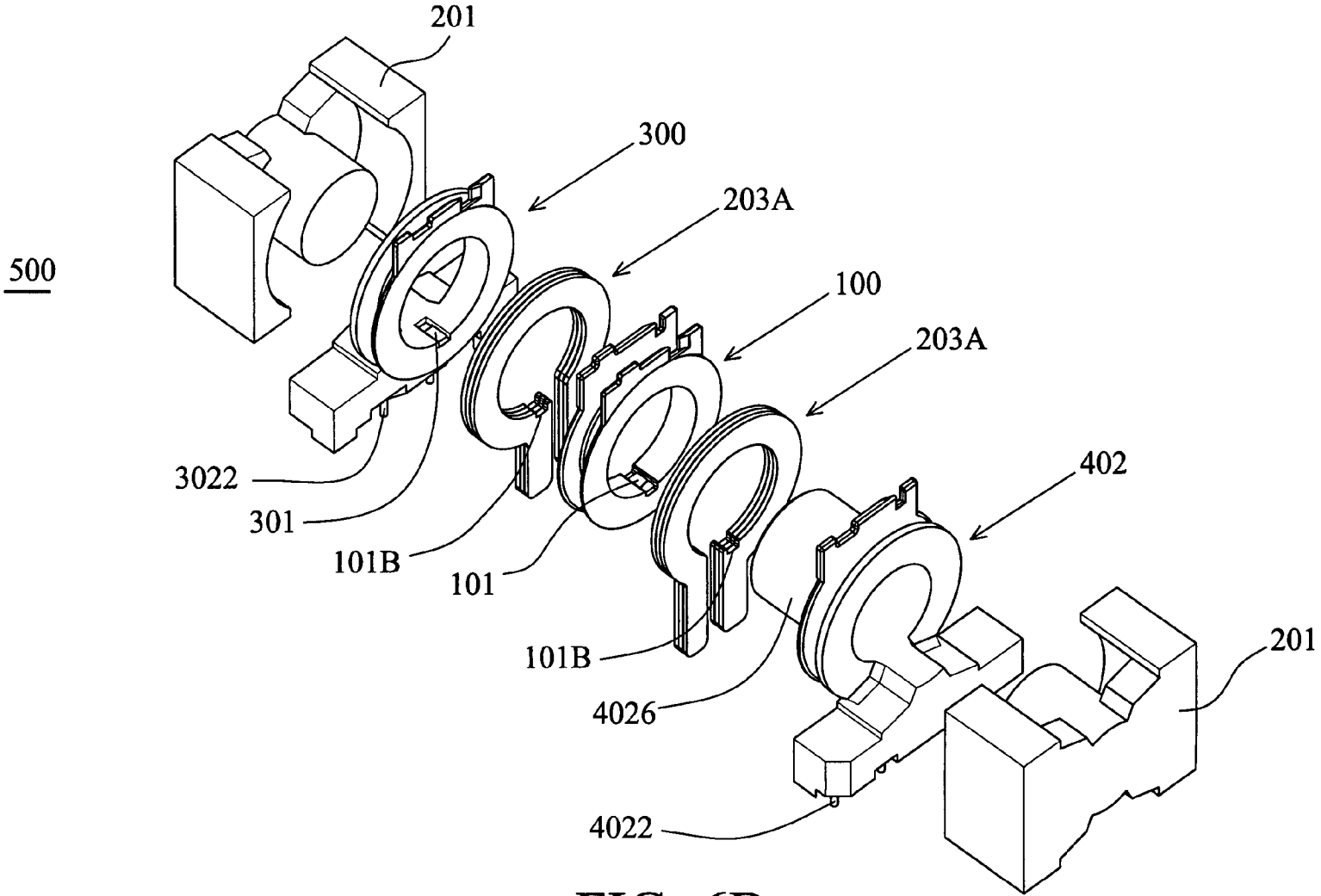
FIG. 6B is an exploded diagram of the transformer shown in FIG. 6A.

FIG. 6B is an exploded diagram of a second embodiment of a transformer 500. The transformer 500 primarily comprises a ferromagnetic core unit 201 formed by two cores, a bobbin 402, at least a first winding unit 100, at least a second winding unit 300, and at least a plate 203A. Elements corresponding to the ferromagnetic core unit 201 and the first winding unit 100 of FIGS. 3B and 6B share the same reference numerals, and explanation thereof is omitted for simplification of the description.

Figure 4:
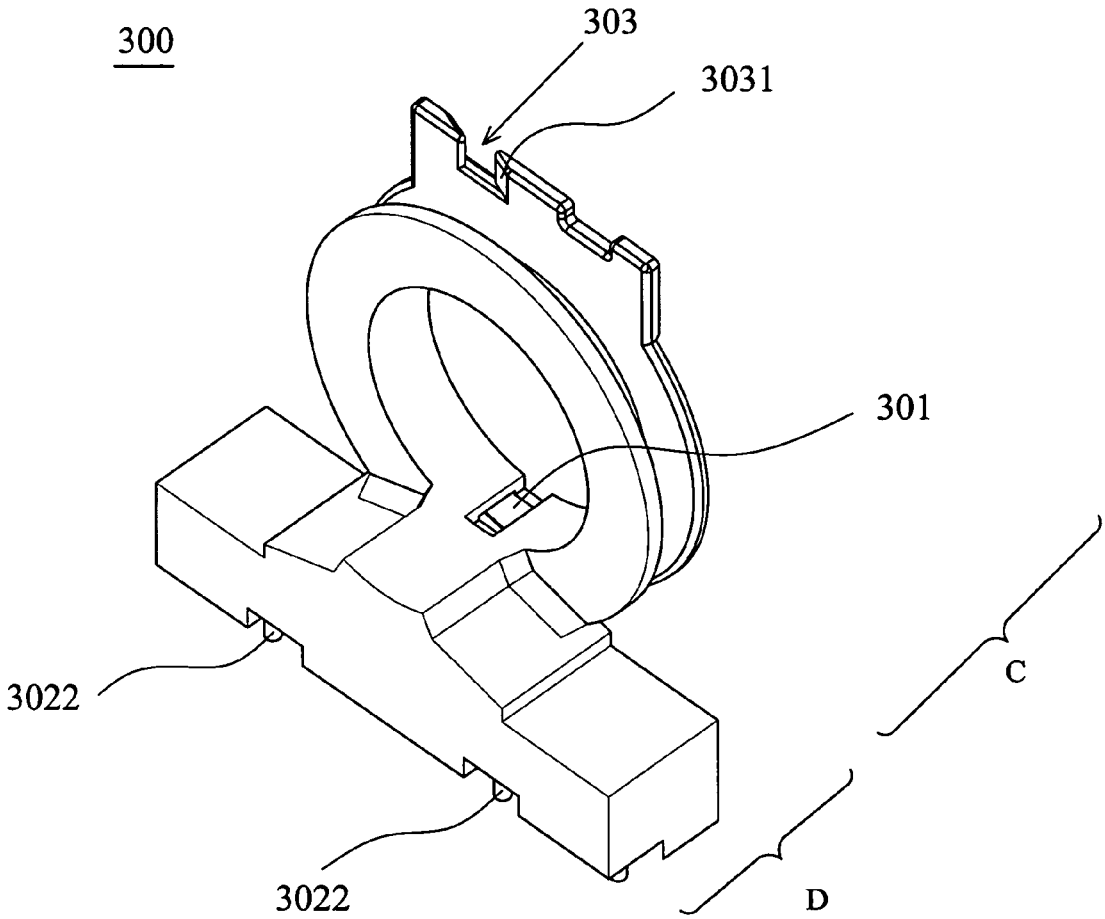
FIG. 4 is a schematic diagram of a second winding unit according to the present invention.

FIG. 4 is a schematic diagram of the second winding unit 300. The second winding unit 300 has a winding portion C and a non-winding portion D. A conductive wire, such as a triple-insulated wire or an enamel-insulated wire (not shown), is wound around the winding portion C substantially on the same plane to facilitate dimension reduction of the transformer. As shown in FIG. 4, the winding portion C comprises an abutting portion 301 and at least a recess 303. The recess 303 has a slope 3031 to receive the conductive wire. The non-winding portion D has at least a pin 3022 with the conductive wire wound thereon.

Figure 5:
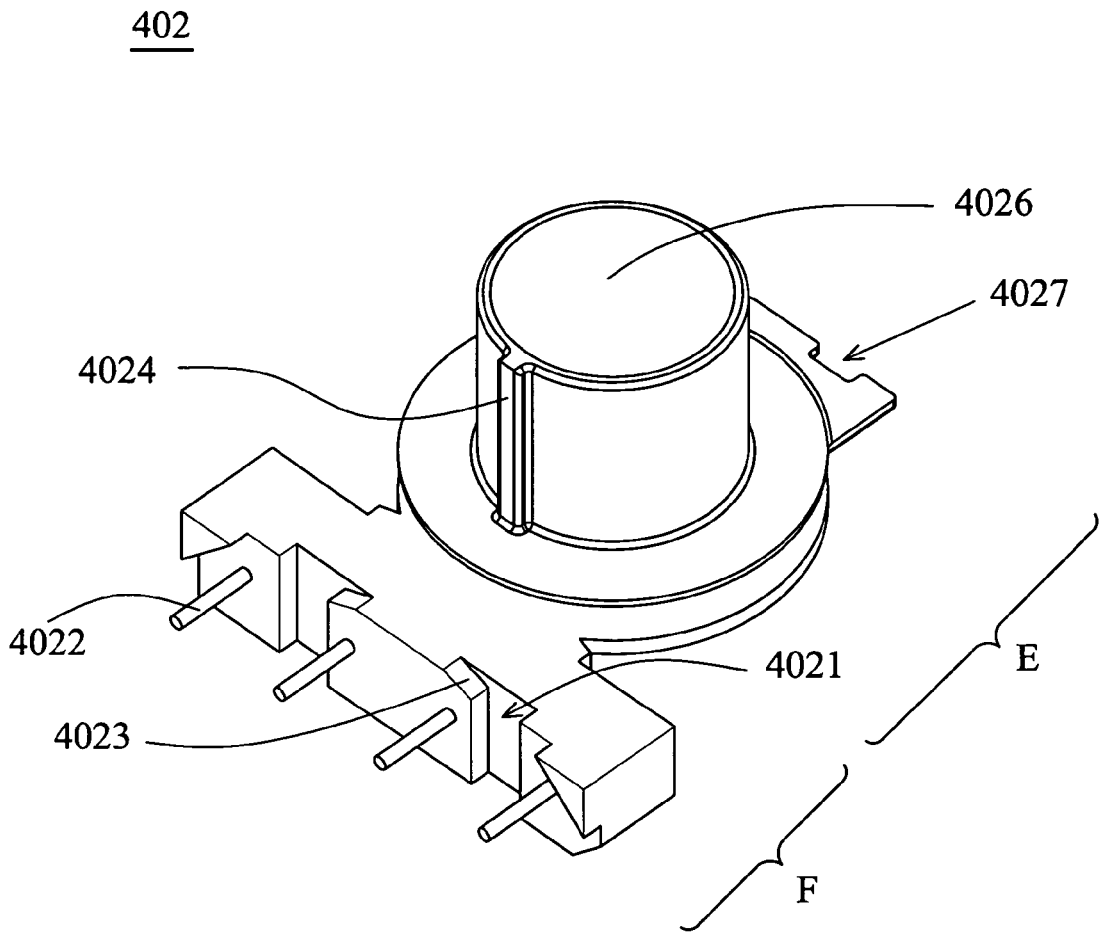
FIG. 5 is a schematic diagram of a second bobbin according to the present invention.

FIG. 5 is a perspective diagram of the bobbin 402. The bobbin 402 has a winding portion E and a non-winding portion F. The winding portion E has at least a recess 4027, a tabular portion 4026 and a third joining portion 4024 disposed on a side of the tabular portion 4026. Profile and dimension of the third joining portion 4024 correspond to the abutting portion 301 of the second winding unit 300 and the first joining portion 101 of the first winding unit 100, as shown in FIG. 6B. The non-winding portion F has at least a recess 4021 and at least a pin 4022 with the conductive wire wound thereon, wherein a slope 4023 is formed on the recess 4021 for leading the conductive wire.

As shown in FIGS. 6A and 6B, the transformer 500 primarily comprises a ferromagnetic core unit 201 formed by two ferromagnetic cores, a bobbin 402 coupled with the ferromagnetic core unit 201, at least a first winding unit 100, at least a second winding unit 300, and at least a plate 203A. The first winding unit 100 is to act as a primary winding and coupled with the bobbin 402. The plate 203A, such as a metal sheet or a circuit board, is to act as a secondary winding and coupled with the bobbin 402. In this embodiment, the plate 203A has a three-layer structure formed by three metal sheets, and the first winding unit 100 and the plate 203A are alternatively stacked in a staggered manner. The space 105 formed between two adjacent first winding units 100 is substantially equal to the size of the plate 203A such that the plate 203A can be accommodated therein. During the assembling of the transformer 500, the third joining portion 4024 of the bobbin 402 is engaged with a second joining portion 101B of the plate 203A, the first joining portion 101 of the first winding unit 100 and abutting portion 301 of the second winding unit 300.

In this embodiment, the first winding unit 100 and the plate 203A are alternately stacked to form a sandwiched structure coupled with the bobbin 402. As shown in FIG. 6B, two parts of the ferromagnetic core unit 201 are assembled with the bobbin 402 respectively from both ends of a tubular portion 4026 thereof, wherein the two parts of the ferromagnetic core unit 201 are E-shaped ferromagnetic cores.

During the assembling, one end of the conductive wire is mounted on the pin 4022 of the bobbin 402. The wire is led through the recess 4021 and across the slope 4023, and then wound on the winding portion E. Next, the wire is led through the recess 4027 with the bobbin 402 fastened through the plate 203A. Subsequently, the wire is then led through a recess 103 and a slope 1031 of the first winding unit 100 and wound on the winding portion A, and then led through a recess 103 and a slope 1031 on the other side of the first winding unit 100. A plurality of plate 203A and first winding unit 100 can be alternatively stacked in a staggered manner by repeating these assembling steps. Finally, the wire is led through the recess 303 and the slope 3031 of the second winding unit 300, and wound on the winding portion C with the tail thereof mounted on the pin 3022.

Unlike the horizontal stack type transformer of the first embodiment, the second embodiment provides a vertical stack type transformer 500, wherein the bolt 250 and hole 2031 as shown in FIG. 3B are omitted.

In some embodiments, some of the winding units are stacked along the bobbin to act as a primary winding, and some of the winding units act as a secondary winding. The ferromagnetic core unit may comprise two E-shaped parts, however, the ferromagnetic core unit may also comprise an E-shaped part and an I-shaped part. In some embodiments, the ferromagnetic core unit may comprise two U-shaped parts and an I-shaped part. The ferromagnetic core unit may also comprise a U-shaped part and a T-shaped part.

According to the embodiments, the winding units of the transformer are easily mounted on a bobbin, wherein turns of the wire wound on each winding unit can be appropriately adjusted for various applications. Moreover, each of the bobbin and the winding units comprises a recess and a slope to facilitate the guidance and to protect the wire, such that unintentional damage of the wire during the assembling is prevented, and life of the transformer is potentially increased.

The invention can avoid excessive height of the transformer structure, saving considerable space for other electronic devices. In some embodiments, each of the winding units comprises a rib press fitted to the bobbin to prevent sliding therebetween and to simplify the assembling of the transformer. Moreover, each of the bobbin, the plate and the insulating sheet comprises a joining portion corresponding to each other, providing easy assembly and firm connection to the bobbin.

Unlike conventional transformers using tapes, the invention provides a transformer having a sandwiched structure to prevent inductance leakage and having high heat dissipation efficiency to suit in various applications.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A transformer, comprising:

a core unit;

a bobbin coupled with the core unit;

at least a winding unit coupled to the bobbin to act as a primary winding, wherein the winding unit has a winding portion with a wire wound thereon and a non-winding portion with an end surface situated on a different plane from that of the winding portion; and at least a plate coupled with the bobbin to act as a secondary winding.

2. The transformer as claimed in claim 1, wherein the wire is wound substantially on the same plane for height reduction of the transformer.

3. The transformer as claimed in claim 1, wherein the wire is a triple-insulated wire or an enamel-insulated wire mounted on a pin of the bobbin.

4. The transformer as claimed in claim 1, wherein the bobbin has at least a recess and a slope formed on the recess for leading the wire therethrough.

5. The transformer as claimed in claim 1, wherein each of the winding unit and the plate respectively has a joining portion to be engaged with a corresponding joining portion of the bobbin.

6. The transformer as claimed in claim 1, further comprising an insulating sheet disposed adjacent to the core unit, the plate or the winding unit.

7. The transformer as claimed in claim 1, wherein the core unit has two E-shaped parts, an E-shaped part and an I-shaped part, a U-shaped part and an I-shaped part, or a U-shaped part and a T-shaped part.

8. The transformer as claimed in claim 1, wherein the plate has a first hole and the bobbin has a second hole corresponding to the first hole for allowing an external bolt to pass through the first and second holes.

9. The transformer as claimed in claim 1, wherein the plate and the winding unit are alternately stacked in a staggered manner.

10. A transformer, comprising:

a core unit;

a bobbin coupled with the core unit, and having a winding portion and a non-winding portion, wherein the non-winding portion has at least a pin;

at least a first winding unit coupled to the bobbin, and having a winding portion with a wire wound thereon and a non-winding portion with an end surface situated on a different plane from that of the winding portion;

a second winding unit coupled with the bobbin and having a winding portion and a non-winding portion, wherein the non-winding portion has at least a pin; and a wire wound through the pin of the bobbin, the winding portion of the bobbin, the winding portion of the first and second winding units, and the pin of the second winding unit.

11. The transformer as claimed in claim 10, further comprising at least a plate coupled with the bobbin.

12. The transformer as claimed in claim 10, wherein the winding portion and the non-winding portion of the first winding unit respectively have end surfaces situated on different planes to form a space for receiving the second plate.

13. The transformer as claimed in claim 10, wherein the winding portion of the bobbin has a tubular portion.

14. The transformer as claimed in claim 13, wherein the first winding unit has a first joining portion, the plate has a second joining portion, the second winding unit has an abutting portion, and the bobbin has a third joining portion on an outer surface thereof corresponding to the abutting portion and the first and second joining portions.

15. The transformer as claimed in claim 10, wherein the plate is a circuit board or a metal sheet.

16. The transformer as claimed in claim 10, wherein the wire is a triple-insulated wire or an enamel-insulated wire.

17. The transformer as claimed in claim 10, wherein the core unit has two E-shaped parts, an E-shaped part and an I-shaped part, a U-shaped part and an I-shaped part, or a U-shaped part and a T-shaped part.

18. The transformer as claimed in claim 10, wherein the core unit has two E-shaped parts, an E-shaped part and an I-shaped part, a U-shaped part and an I-shaped part, or a U-shaped part and a T-shaped part.

19. The transformer as claimed in claim 10, wherein the core unit has two E-shaped parts, an E-shaped part and an I-shaped part, a U-shaped part and an I-shaped part, or a U-shaped part and a T-shaped part.

20. The transformer as claimed in claim 13, wherein the first winding unit has a first joining portion, the second winding unit has an abutting portion, and the tubular portion has a second joining portion on an outer surface thereof corresponding to the first joining portion and the abutting portion.

21. The transformer as claimed in claim 11, wherein the plate is a circuit board or a metal sheet.

22. The transformer as claimed in claim 10, wherein the wire is a triple-insulated wire or an enamel-insulated wire.

23. The transformer as claimed in claim 10, wherein the core unit has two E-shaped parts, an E-shaped part and an I-shaped part, a U-shaped part and an I-shaped part, or a U-shaped part and a T-shaped part.

24. The transformer as claimed in claim 10, wherein the first winding unit further comprises a recess having a slope for receiving the wire.

25. The transformer as claimed in claim 1, wherein the winding unit further comprises a recess having a slope for receiving the wire.

* * * * *